United States Patent [19]

Miller et al.

[11] 4,221,380

[45] Sep. 9, 1980

[54] SIMULATED VEHICLE RADAR TRANSCEIVER

[76] Inventors: Jack V. Miller; Mark R. Miller, both of 700 N. Auburn Ave., Sierra Madre, Calif. 91024

[21] Appl. No.: 962,213

[22] Filed: Nov. 20, 1978

[51] Int. Cl.[2] ..... A63J 3/00

[52] U.S. Cl. ..... 272/8 N; 40/538; D10/104

[58] Field of Search ..... 40/538, 591, 540; 343/8, 18 E; 346/107; 272/8 N, 8 R; D10/104; 428/31; 340/97, 145; 46/227, 1 E

[56] References Cited

U.S. PATENT DOCUMENTS 2,645,769 7/1953 Van Roberts ..... 343/8

OTHER PUBLICATIONS

Dunagin's People, Ralph Dunagin, Washington Post Cartoon, Oct. 18, 1978.

Police-radar Detectors, Radio Electronics, p. 88, Mar. 1978.

*Primary Examiner*—John F. Pitrelli

[57] ABSTRACT

A simulated vehicle radar transceiver is molded as a single, unitary piece of plastic material in the form of an elongated body having a large end which simulates the visual appearance of a vehicle radar antenna, a smaller end, and a horizontal projection which is adapted to be clamped between the top edge of an automobile window and the top of the respective window frame.

4 Claims, 8 Drawing Figures

SIMULATED VEHICLE RADAR TRANSCEIVER

BACKGROUND OF THE INVENTION

The use of radar devices is common in the enforcement of speed laws by police agencies. The physical presence of such radar devices on a police car is a deterrent to speeding. Most police agencies are not able to provide radar equipment on the majority of cars in traffic service because of the high cost of the radar units.

SUMMARY OF THE INVENTION

This invention provides a simulated radar device which may be manufactured at very low cost, and which simulates the appearance of a police radar unit mounted in the window of a police car. The decoy radar device according to the invention is an elognated body of soft, foam plastic material which terminates at one end in a generally flat vertical plane having the appearance of an antenna. A horizontally projecting rail extends substantially the length of the body, and is adapted to be clamped against the top of a car window frame by cranking the glass up against the projection of the simulated radar. The planar surface of the antenna simulation is more reflective than the rest of the decoy body to facilitate observation by approaching motorists. Preferred embodiments have a channel to receive the top edge of the car window, and detailed simulation of the radar antenna in the form of a truncated cone wherein the base of the cone is the vertical plane of the antenna.

DESCRIPTION OF THE DRAWINGS

Referring to the accompanying drawings.

DETAILED DESCRIPTION OF THE PREFERRED EMBODYMENTS

Figure 1:
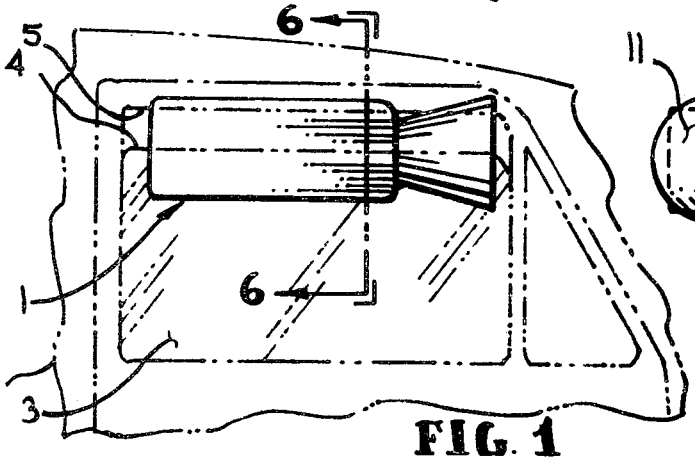
FIG. 1 is a side elevation view of the simulated vehicle radar transceiver according to the invention and shown is use as a radar decoy on a motor vehicle.

Referring to FIG. 1 a simulated vehicle radar transceiver, hereinafter referred to as a "decoy" 1 is shown in use on a motor vehicle 2, shown in phantom, and is mounted on the window 3 by clamping the decoy 1 between the top edge 4 of window 3 and the top window frame 5.

Figure 2:
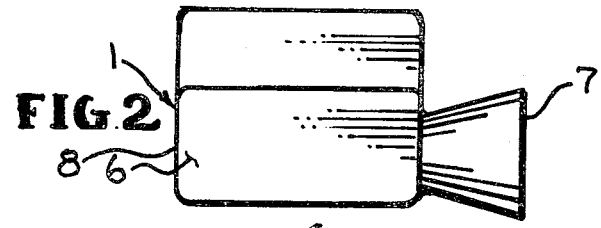
FIG. 2 is a top plan view of the invention as shown in FIG. 1.

In FIG. 2 the decoy 1 is shown in plan view and having an elongated body 6 with a large end 7 and a smaller end 8.

Figure 3:
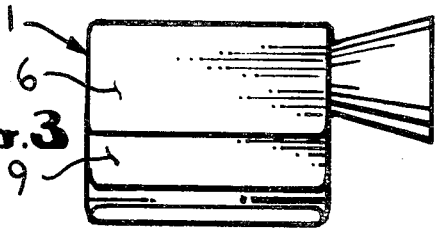
FIG. 3 is a bottom plan view of the invention as shown in FIG. 1.

In FIG. 3 the decoy 1 is shown in a bottom plan view and showing a generally parallelopiped projection 9 extending from body 6.

Figure 4:
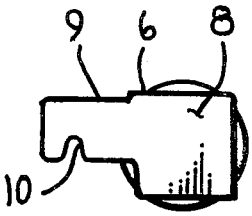
FIG. 4 is a front elevation view of the invention as shown in FIG. 1.

In FIG. 4 the decoy 1 is shown having the smaller end 8 of body 6 extending into projection 9, which is provided with a window receiving channel 10 along its length.

Figure 5:
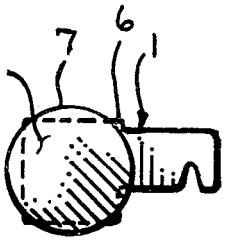
FIG. 5 is a rear elevation view of the invention as shown in FIG. 1.

In FIG. 5 the large end 7 of decoy 1 is shown having a generally planar surface 11 in a vertical plane which is normal to the long axis of body 6.

Figure 6:
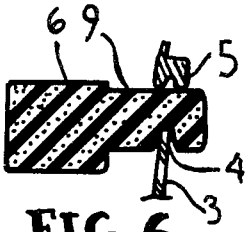
FIG. 6 is a cross-sectional view of the invention, taken along section line 6—6 of Fig. 1.

In FIG. 6, a cross-sectional view through section line 6—6 of FIG. 1, body 6 is shown as made of an elastomeric foam material and having projection 9 clamped between the top edge 4 of a motor vehicle window 3 and the respective top window frame 5.

Figure 7:
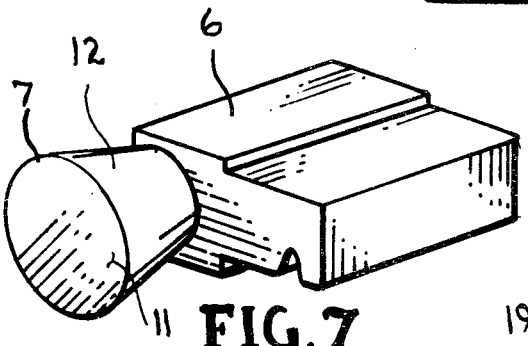
FIG. 7 is a perspective view of the preferred embodyment of the invention shown in FIG. 1.

In FIG. 7 decoy 1 is shown wherein body 6 has its larger end 7 terminated in the vertical plane 11, which comprises the base plane of a truncated cone 12.

Figure 8:
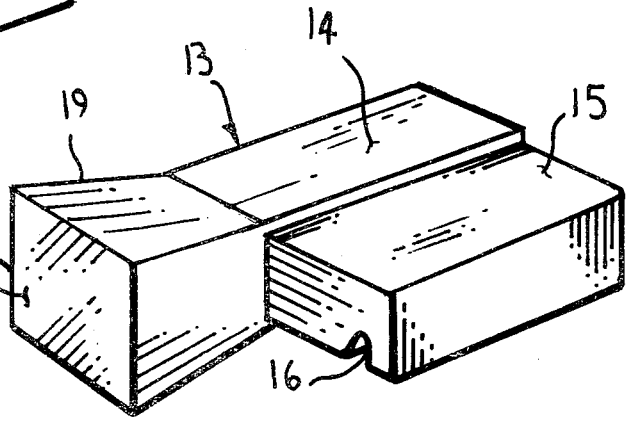
FIG. 8 is another preferred embodyment of the invention, shown in perspective.

In FIG. 8 an alternate embodyment is shown of a decoy 13 having an elongated body 14 and an attached projection 15 which is provided with a full length channel 16. Body 14 has a large end 17 which terminates in a generally planar vertical surface 18, comprising the base plane of a truncated pyramid 19.

We claim:

1. A simulated vehicle radar transceiver comprising a horizontally disposed elongated body having a small end and a large end;

a generally planar surface terminating the large end in a plane normal to the long axis of the body;

a generally parallelopiped projection extending laterally from the side of the elongated body in the horizontal plane and being of sufficient length to be clamped between the top edge of a motor vehicle side window and the top frame of said window;

said parallelopiped projection is provided with a groove along its lower surface which is adapted to receive the top edge of the side window of the motor vehicle and whereby the body is held in the generally horizontal plane clamping said projection between the frame top and the top edge of said window; and the described structure is molded of a single unitary piece of plastic material.

2. A simulated vehicle radar transceiver according to claim 1 in which the plastic material comprises elastomeric foam material.

3. A simulated vehicle radar transceiver according to claim 1 in which the horizontally disposed elongated body is generally in the form of a parallelopiped joined to the smaller end of a truncated cone wherein the larger end of said cone comprises a vertical planar surface normal to the long axis of the elongated body.

4. A simulated vehicle radar transceiver according to claim 1 in which the vertical plane of the large end has a reflectance of at least 50% and the remaining surfaces have less than 50% reflectance.

* * * * *